United States Patent [19]

Winkler

[11] 4,434,622

[45] Mar. 6, 1984

[54] REGENERATIVE CYCLIC PROCESS FOR REFRIGERATING MACHINES

[75] Inventor: Otto Winkler, Balzers, Liechtenstein

[73] Assignee: Balzers Aktiengesellschaft, Liechtenstein

[21] Appl. No.: 384,931

[22] Filed: Jun. 4, 1982

[30] Foreign Application Priority Data

Jun. 5, 1981 [CH] Switzerland ..... 3700/81

[51] Int. Cl.[3] ..... F25B 9/00

[52] U.S. Cl. ..... 62/6; 60/520

[58] Field of Search ..... 62/6; 60/517, 520

[56] References Cited

U.S. PATENT DOCUMENTS 3,625,015 12/1971 Chellis ..... 62/6

*Primary Examiner*—Ronald C. Capossela

*Attorney, Agent, or Firm*—McGlew and Tuttle

[57] ABSTRACT

A regenerative, thermodynamic cyclic process for refrigerating machines employing a high-speed compressor. During an expansion phase, a gaseous coolant is pumped by this compressor directly out of a working volume and transferred, under compression, into an intermediate tank or into a second working volume, and during a following compression phase, the coolant is pumped by the compressor out of the intermediate tank or the second working volume, while using a reversing valve actuated to operate in synchronism with a displacer movement, and returned to the first working volume of the refrigerating machine. The expended compression work is thus recovered.

6 Claims, 7 Drawing Figures

REGENERATIVE CYCLIC PROCESS FOR REFRIGERATING MACHINES

FIELD AND BACKGROUND OF THE INVENTION

The present invention relates to a method and device for producing low temperatures, particularly with a closed-circuit refrigerating machine.

Refrigerating machines with small refrigerating power for reaching very low temperatures without an additional supply of refrigerant, i.e. autonomously, are being employed at an increasing rate in laboratories and industry, for example, as cryopumps in vacuum apparatus. Gaseous high-pressure helium is used as the coolant.

Such refrigerating machines mostly are based on the Stirling or Gifford-McMahon methods. These two methods differ from each other mainly in that in the first one, the work done on expansion and effecting the refrigeration is partly recovered. This is obtained by moving a displacer in synchronism with a compressor piston, which is effected by mechanical coupling. This results in a relatively high efficiency, but also in the drawback that no inexpensive, high-speed compressor can be employed, because of the limited, relatively low frequency of the cycle and the coupling of the displacer. The low speed requires a correspondingly large gyrating mass of the machine since this alone ensures a satisfactory energy accumulation during the expansion phase. That is why the manufacturing costs of such refrigerating machines are relatively high. In addition, standard component parts cannot be used for constructing refrigerating machines having different capacities and temperature ranges.

The Gifford-McMahon method bypasses this problem by uncoupling the compressor from the refrigerating machine. In this method, the high-pressure gas is supplied cyclically with the displacer motion during the compression phase, from a high-pressure accumulator through externally controlled valves and is then recycled during the expansion phase to a low-pressure accumulator. The sole task of the compressor thus is to compress the low-pressure gas and supply it again to the high-pressure accumulator. That is why the Gifford-McMahon method is a simple, inexpensive technical solution which also is reliable in operation. A disadvantage is only the higher energy consumption.

SUMMARY OF THE INVENTION

The present invention provides a novel cyclical method for refrigerating machines, combining the advantage of the two above mentioned methods and avoiding their, and even other, disadvantages.

In the inventive cyclic method, a high speed compressor is connected in synchronism with the displacer motion and by means of a valve control, to the working volume in the refrigerating head of the refrigerating machine, for charging during one half of the cycle and for discharging during the other half of the cycle. During the charging period, the gas is taken from a gas supply vessel under medium pressure, and during the discharging period, it is pumped back into the vessel. A great part of the compression work is thereby recovered. Also, the differential pressure at the compressor is thus reduced to one half and the adiabatic compression work is reduced in addition as a result of the reduced pressure ratio.

In another embodiment, the working volume of another cryogenerator which is separated from the first one or forms therewith a construction unit, is used instead of the supply vessel. The two working volumes are thus connected to the suction and discharge sides of the compressor alternately and countercurrently. In both instances, the optimum, theoretically possible Carnot efficiency can be approached very closely.

The obtained energy economy results in another advantage, namely that the costs of cooling the compressor are reduced. If no very high refrigerating performances are required, a simple air cooling is satisfactory. And in installations with a higher performance, the otherwise usual heat exchanger may be omitted in the air cooling system.

As mentioned, the valves are controlled in synchronism with the movement of the displacer. This requires a coupling between the drive piston of the displacer and the reversing valve. A pneumatic coupling is particularly advantageous and if, in addition, the displacer is also driven pneumatically, the result is a very simple space saving, and reliable solution which permits variations in the cycle frequency, and suitable even for higher refrigerating performances.

Accordingly, an object of the present invention is to provide a regenerative cyclic process for a refrigerating machine having a displacer and having an expansion phase and a compression phase, comprising, directly pumping a gas coolant out of a working volume of the refrigerating machine during the expansion phase of the cyclic process, by means of a compressor and compressing the coolant to a higher pressure into an intermediate vessel, and during a following compression phase, pumping the coolant out of the intermediate vessel by the same compressor and returning it to the working volume.

A further object of the invention is to provide a regenerative refrigerating machine comprising a housing defining a working volume, a displacer movable in the housing for changing the working volume, a regenerator communicating with the working volume for receiving pressurized gaseous coolant during a compression phase and discharging the pressurized gaseous coolant during an expansion phase, means connected to the displacer for moving the displacer, a compressor having a high pressure side and a low pressure side, valve means connected between the compressor and the working space and an intermediate vessel connected to the valve, said compressor operable to directly pump the gaseous coolant out of the working volume, to increase its pressure and supply it to the intermediate vessel during an expansion phase, and during a following compression phase, for pumping the coolant out of the intermediate vessel to the working volume.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
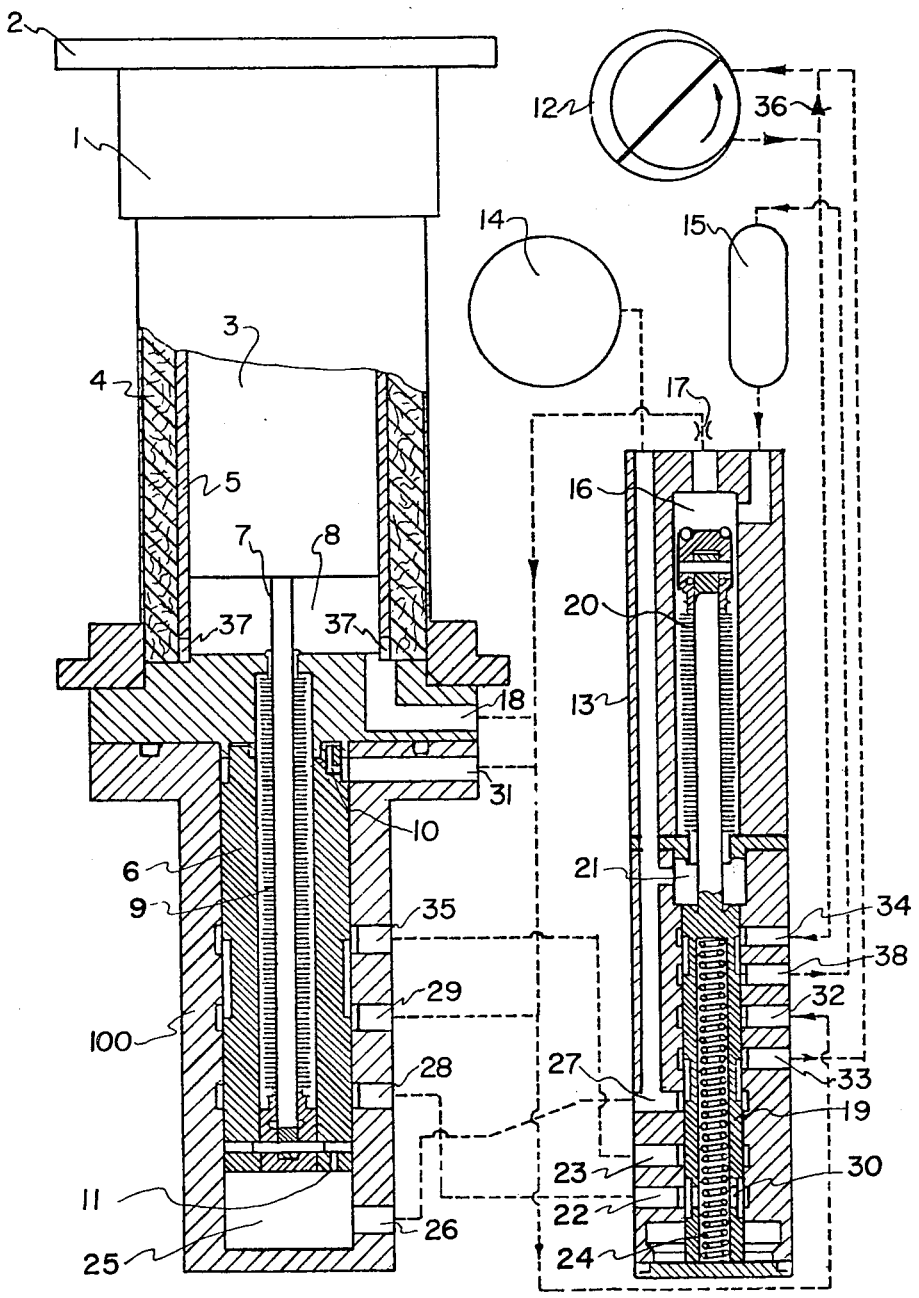
FIG. 1 is a sectional view partly in elevation which diagrammatically illustrates the design of the inventive system with a single-stage refrigerating machine and while employing an oil lubricated compressor.

In FIG. 1, numeral 1 designates the refrigerating head of the refrigerating machine or cryogenerator, where a cold condition is produced. The surfaces to be cooled are screwed to terminal plate 2. Within the refrigerating head, a displacer 3 and a regenerator 4 are received which are separated from each other by a cylindrical intermediate wall 5 of low thermal conduction. Through a rod 7, a drive piston 6 moves displacer 3 periodically up and down during which motion the gas in space 8 above or below the displacer is forced to flow through ports 37 and through regenerator 4, back and forth. The gas for pneumatically actuated piston 6 is separated from the gas in space 8 by a spring bellows 9.

The abutting of piston 6 in its upper and lower end positions of its stroke is damped by the friction of the gas flowing out from a pneumatic cushion which forms at the upper and lower ends of the stroke shortly before the piston stops. The gas flows out both through side gaps between the piston and its guidance housing 100 and through throttles 10 and 11.

The compression and expansion of the gas volume present in the refrigerating head 1 (termed working volume in the following) is effected by a compressor 12 operating in synchronism with the motion of the displacer 3. Advantageously, a rotating piston compressor is employed which, because of the separation of the suction space from the discharger space and in contrast to a reciprocating piston compressor, does not require externally controlled inlet and outlet valves in this application. Such a compressor has the further advantage that because of its small size, it can be entirely hermetic even at higher refrigerating performances and in addition, because of its mechanical stability, it can be operated at a substantially higher pressure which, as will be shown later, contributes to energy savings.

In accordance with the invention, the compressor 12 is used during one half of the cycle for charging, and during the other half of the cycle for discharging the working volume 8 in the cooling head. During the charging period, gas is pumped by compressor 12 from an intermediate tank 14 which is under medium pressure, into a high-pressure tank 15 which serves as an oil separator at the same time. Therefrom, the gas passes through a valve zone 16 and throttle 17 to the cooling head 1 at inlet 18. During the discharge period, the suction side of the compressor 12 is connected to the cooling head at 18 and the high-pressure side is connected to intermediate tank 14.

For reversal, a control valve 13 is provided. This valve comprises a control piston 19 which is separated from the oil-free zone 16 by a spring bellows 20. The upper side of the control piston 19 continuously communicates at 21 with intermediate tank 14, and consequently, is permenantly under a medium pressure. Control piston 19 is actuated by sudden blows of high-pressure or low-pressure gas supplied at 22 or 23 each time drive piston 6 of the displacer reaches its end position. This gas enters the interior of piston 19 over aperture 30 to urge the piston up or down. To prevent an excess pressure at the discharge side during the reversal of the compressor, the inlet and outlet lines are bridged by a pressure-relief valve 36.

In this way, drive piston 6 of displacer 3 serves as a contol valve for control piston 19.

A spring 24 provided within control piston 19 serves the sole purpose of ensuring a definite position of the control piston at the start of the operation of the machine, thus does not participate in the control proper.

Figure 2:
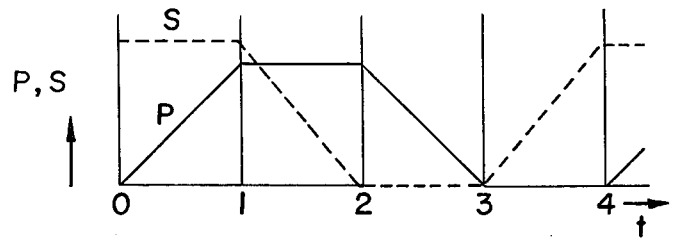
FIG. 2 is a graph that shows the ideal variation aimed for of the pressure and the displacer motion during the cyclic process.

In the following, the function is described in more detail:

FIG. 2 shows the desired ideal variation of the pressure and displacer motion in the cooling head during a cycle of the process, as a function of the time t. The cycle is divided into four phases. The dotted line indicates the displacement s of the displacer, the solid line indicates the pressure p during the cycle.

FIG. 1 corresponds to the start at $t=0$ of the cycle. The displacer is in its upper dead center position. The compressor is going to charge the working volume 8 in the cooling head. The underside of the control piston 19 has just an instant earlier been connected to the low-pressure side of the compressor, through 23, 35, 29, 32 and 33. Space 25 at the underside of drive piston 6 is permanently connected through 26,27 to intermediate tank 14. As soon as the pressure at the upper side of drive piston 6 (at 31) exceeds this medium pressure (phase 0–1 in FIG. 2), theoretically, the displacer starts moving downwardly. However, this motion is delayed for two reasons; first, because a suction-cup effect has been produced in the space where the damping upper gas cushion was, the missing gas must be re-supplied through throttle 10; second, an upwardly directed pressure difference becomes effective at the displacer, which is caused by the resistance of regenerator 4 to the gas flow into the cooling head. This means that the motion actually starts only after the difference between the high pressure at 18 and the medium pressure at 25 exceeds a certain level. As soon as piston 6 reaches its lower dead center position, i.e. at the start of phase 2 according to FIG. 2, a connection between 28 and 29 is established and high pressure passes at 22 through bores 30 to the underside of control piston 19 which is thereby suddenly thrust upwardly thereby reversing the gas flow of the compressor. Valve zone or space 16 is closed. The gas present in the cooling head and at the upper side of piston 6 is pumped out through 18, 31,32, and 33. The gas delivered by the compressor passes through 34,21 to intermediate tank 14. This tank now receives back the gas amount it has delivered up to the start of phase 2.

As soon as the pressure at 18 and 31 has dropped below the medium pressure, piston 6 starts moving upwardly, again with delay (phase 3-4), and upon reaching the upper dead center position (4=0), the underside of control piston 19 is brought to low pressure through 29,35,23 and bores 30. Control piston 19 is thus returned to its position shown in FIG. 1, and the next cycle starts.

The following specific example may illustrate the possibilities of the novel cyclic process:

Let it be assumed that in a single stage and at 80° K., the refrigerating machine is to have a theoretical refrigerating power of 200 W (this then corresponds to a useful refrigerating power of 80 to 100 W, because of the heat supply through conduction and radiation, the regenerator losses, and the unavoidable deviations from the ideal displacer motion and pressure variations shown in FIG. 2) Assume further, two cycles per second and a compressor suction pressure $p_l$ of 4 bar, which is usual today in commercially available cyrogenerators, and a discharge pressure $p_h$ of 18 bar.

The theoretical refrigerating power $\dot{Q}$ is $$\dot{Q}=f\oint Vdp=fV\Delta p=fV(p_h-p_l)$$

wherein V is the expanding volume above the displacer, with the displacer in its lower dead center position (which volume is approximately equal to volume 8), and f in second$^{-1}$ is the frequency of a cycle.

With the above indicated pressure and the required refrigerating power and frequency, the value of V is approximately 0.07 liter. Then, assuming a free regenerator volume of the same magnitude, the necessary net compression power W in the prior-art Gifford-McMahon method, without an intermediate tank and without a compressor reversal, i.e. with the gas being supplied from a high pressure tank, returned to a low pressure accumulator and then pumped by the compressor again to the higher pressure level, will be W=2.8 kW. With a pressure of 4 bar, the necessary pumping speed of the compressor is then 3.2 l/s. Consequently, the ratio of the theoretical compression power to the theoretical refrigerating power is W.Q=14. It follows from the equation for Q that the refrigerating power is only a function of $\Delta p$ and is independent of the pressure level. This does not apply to the adiabatic compression work W to be expended and which, for a definite mass of gas, is proportional to the term $$[(p_h/p_l)^{(\gamma-1)/\gamma-1}],$$

wherein $\gamma=(C_p/C_v)$.

Since with an increasing pressure level and a constant $\Delta p$, the ratio $p_h/p_l$ continually decreases, the expended power may be reduced by increasing the pressure. This is possible if, as mentioned above, a hermetically sealed rotating piston compressor is employed (which, advantageously, is incorporated in the medium pressure gas accumulator 14). While choosing, for example, $P_l=16$ bar and $P_h=30$ bar, the compression power drops to one half, because of the more favorable pressure ratio of $P_h/P_l$. The ratio of W/Q is therefore only 7 and the needed pumping speed of the compressor is reduced to about $\frac{1}{3}$.

If now the same pressures are provided in the inventive process and with an average pressure of $p_m=23$ bar in the intermediate tank, the pressure ratio at the compressor is once more reduced to $\frac{1}{2}$ and in addition, the portion of the compression energy is recovered during the discharge phase of the refrigerating head. Then, the compression power is only W=0.8 KW and the ratio W/Q=4. This already is very close to the theoretical minimum of W/Q=2.75 which is possible at 80° K. according to Carnot.

Since, unlike in the prior art, the charging by the compressor within the predetermined period of the cycle is not effected continuously and, for one half of this period, the compressor is also used for discharging the refrigerating head, it is available for charging only during one half the period too. Therefore, in spite of the new higher suction pressure, the pumping speed S of the compressor must be higher. It is now S=1.6 l/s, which, however, is still almost one half of the speed originally needed at the low pressure level.

In addition to the energy saving, an important advantage is obtained in that the pressure difference at the compressor is reduced to one half. No multistage compressor is needed. Less heat is developed by the compressor and the life of the compressor is extended since the mechanical load is small. Since the compressor may run at a high speed, the inherent gyrating mass of the compressor and motor is sufficiently high to be capable of absorbing the energy given off during the expansion and rendering it subsequently useful again.

Figure 3:
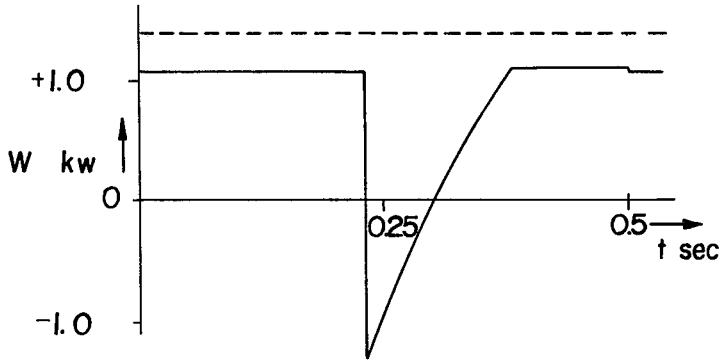
FIG. 3 is a graph that shows the variation in time of the compression power during a cyclic process with the arrangement of FIG. 1.

By plotting the power requirement against the time during the cycle, the diagram of FIG. 3 is obtained for an ideal variation of the displacement motion according to FIG. 2. During one half of the cycle, up to phase 2 (charging), a constant compression power of about 1.1 KW is needed. During the phase between 2 and 3, first, power is won, and then consumed again. The negative and positive power-time integrals almost compensate each other. During the last phase, again about 1.1 KW is needed.

The dotted horizontal line shows the power requirement for a prior-art Gifford-McMahon process, already at a higher pressure level.

Figure 4:
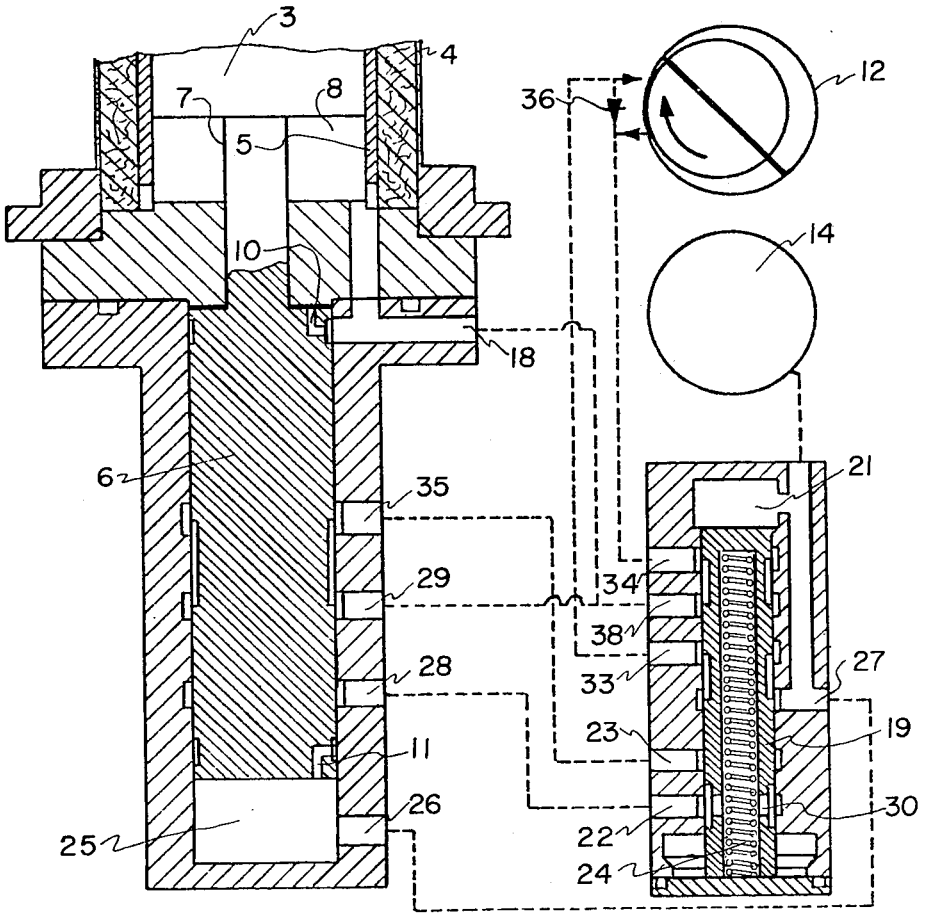
FIG. 4 is a sectional view which diagrammatically illustrates an embodiment with a dry running compressor.

A still better approximation of the ideal Carnot efficiency may be obtained by a solution according to FIG. 4, i.e. a second embodiment. In principle, the same control is used and parts having like functions are designated in FIG. 4 with the same reference numerals as in FIG. 1.

This second embodiment differs from the first one mainly by the use of a dry running compressor, so that no oil separator is needed, and no high-pressure accumulator is provided. Unlike in the first embodiment, the working volume can be changed by the compressor directly, and the compression energy can also be recovered during this phase.

In contradistinction to the first embodiment, no oil-sealed valves are needed, but dry control valves are employed. There is no longer need for separating oil lubricated and dry regions from each other by means of spring bellows. On the other hand, narrower tolerances are needed for control valve piston 19 and drive piston 6, which is achievable with conventional means, however. Another possibility is to use sprung sealing sleeves of teflon for sealing the valve passages.

Figure 5:
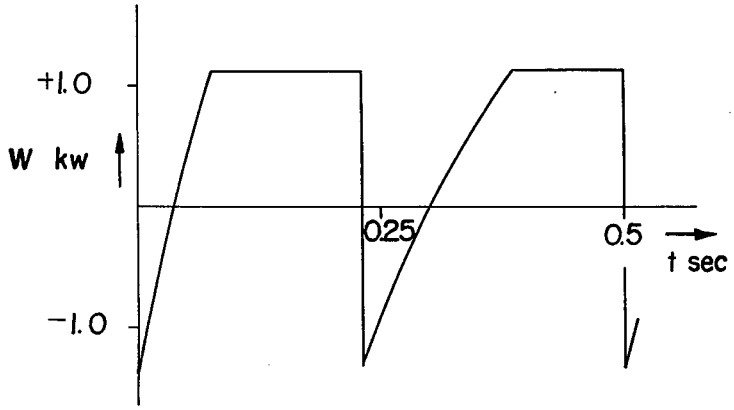
FIG. 5 is a graph which shows the variation in time of the compression power in the embodiment of FIG. 4.

FIG. 4 shows the cryogenerator in the same initial position as in FIG. 1, wherefore the control sequence is identical with that of the first embodiment. FIG. 5 shows the theoretical variation of the power input under the assumption that the pressure varies and the displacer moves in accordance with FIG. 2. This leads theoretically to a ratio W/Q of about 3.5. The necessary pumping speed of the compressor is again 1.6 l/s, thus the same as in the first embodiment.

This solution offers still another advantage in that now during both phases, i.e. during the discharge as well as during the charge of the working volume, the rate of flow of the gas through the regenerator is determined by the conveying effect of the compressor, wherefore it necessarily varies within only small limits, in the considered example within the ratio of $p_h/p_l$ i.e. about by the factor 2 from the start to the end of each charging or discharging operation. This results in a very close approximation to the required pressure variation of FIG. 2.

Basically, an oil lubricated compressor may also be employed, provided that the compressor is hermetically separated from the cryogenerator circuit by means of a pressure transmitter, and the hermetic separation between the working volume and the drive piston of the displacer, as shown in FIG. 1, is maintained. Since such a pressure transmitter increases the dead volume, the pumping speed of the compressor must there be almost doubled as compared to the second embodiment, i.e. a slightly higher frictional loss must be taken into account. The compression power remains almost the same, however.

Figure 6:
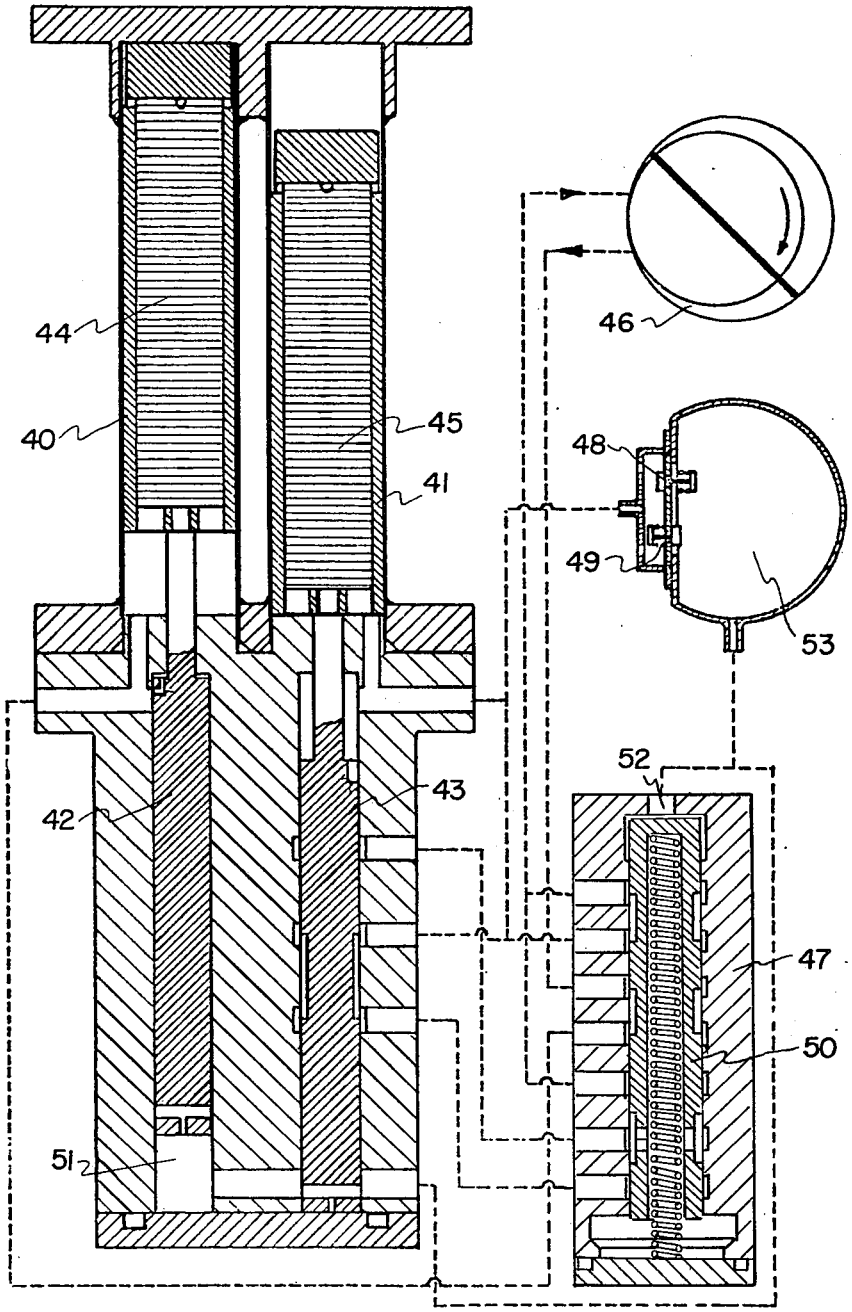
FIGS. 6 and 7 are section views which illustrate two further embodiments of the invention with a dry running compressor, in which two cryogenerators are coupled to the compressor, FIG. 6 showing a single-stage design and FIG. 7 a two-stage design.
Figure 7:
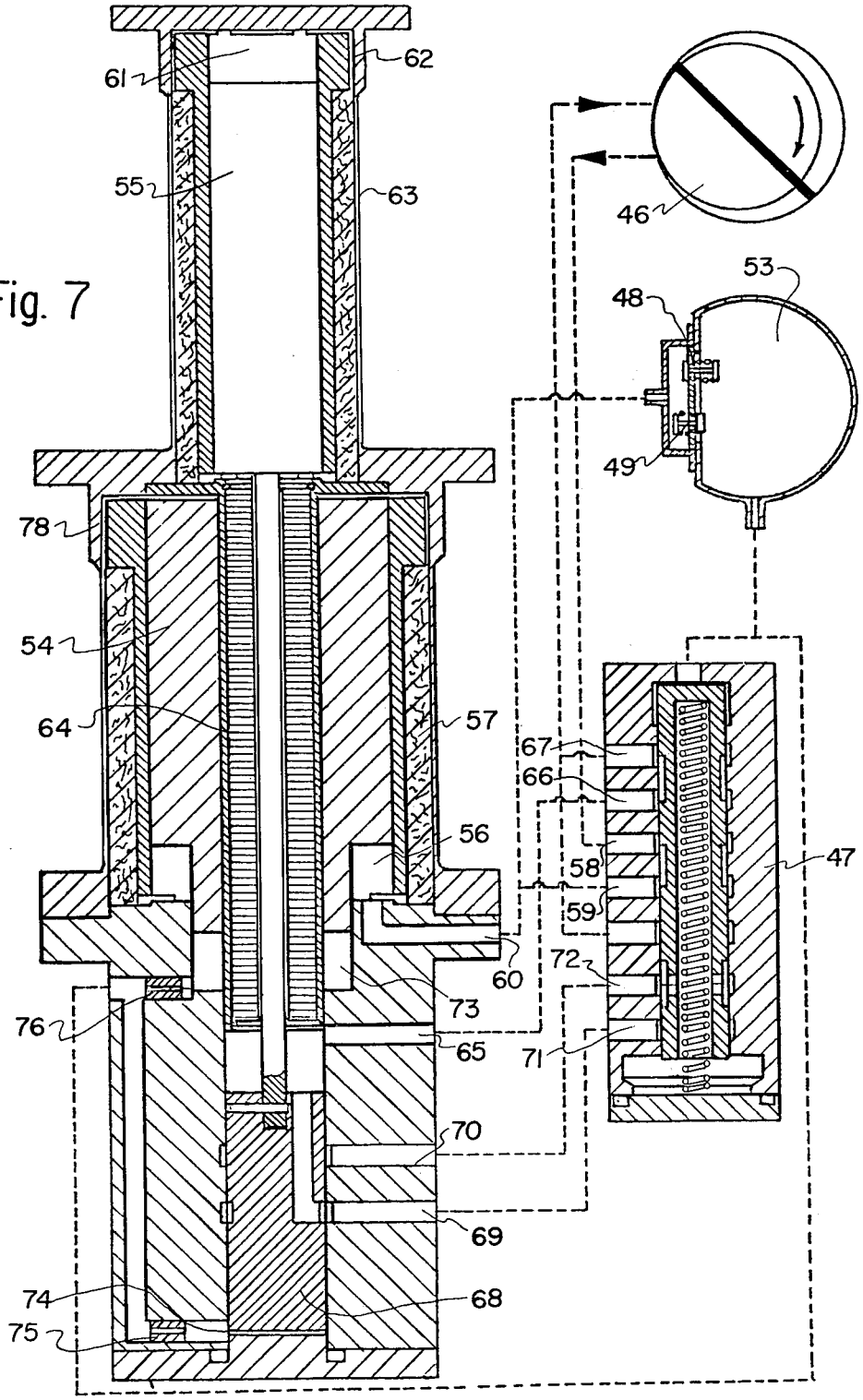

In the above solutions, the compressor is available for charging the working volume only for half the time, so that its pumping speed must be higher than if the compression were effected directly from the minimum pressure $p_l$ to the maximum pressure $P_h$. In the embodiments of FIGS. 6 and 7, this drawback is avoided. During the expansion phase, the gas is no longer compressed into an intermediate tank which is under medium pressure, but directly into the working volume of another cryogenerator which is connected in parallel. As shown in FIG. 6, both displacers may be connected to a common refrigerating head. However, as shown in FIG. 7 illustrating an example of a two-stage cryogenerator, they may also be mounted in two separate refrigerating heads.

FIG. 6 shows two displacers 40, 41 which are actuated in phase opposition. Each displacer is connected to a drive piston 42, 43 respectively. The regenerators 44, 45 which are made of a bronze lattice are received within the displacers. As in the previous solutions, the compressor 46 must be reversed after each semicycle, by means of a reversing valve 47, to take off or compress the gas in the two working volumes. The operation is the same as described above. One of drive pistons 43 is used for the reversal. Supply tank 53 is under a medium pressure. This tank serves as a gas buffer ensuring that independently of the operating condition of the refrigerating machine, i.e. during the starting period, approximately, the medium pressure for which the machine is rated, is maintained in the system. In addition, the buffer delivers the reference pressure for displacer drive pistons 42, 43 at 51, and for reversing valve 47 at 52. Two spring-loaded outlet and inlet valves 48, 49 of supply tank 53 are set to a definite differential pressure and open as soon as the pressure difference between the medium pressure in 53 and the maximum or minimum pressure at the refrigerating head exceeds or does not attain the desired value.

In this solution, with an identical theoretical refrigeration power of Q=200 Watt, and identical maximum and minimum pressures and cycle frequency as before, a compressor pumping speed of only slightly more than one liter per second is necessary.

Here again, the employment of the dry running compressor has been assumed. With an oil lubricated compressor, two pressure transmitters are now necessary for separating the gas circuit of the compressor from the working volume, and two spring bellows are needed for drive pistons 42, 43 such as in FIG. 1. Because of the larger dead volume, a pumping speed of 1.6 l/s of the compressor is necessary. The pressure ratio at the compressor is doubled, so that the compression power is somewhat increased. However, because of the low frictional losses of the smaller compressor, the power rating is not substantially affected.

FIG. 7 shows how the invention may be applied to a two-stage refrigerating machine. The compressor 46, supply tank 53 with outlet and inlet valves 48, 49 and reversing valve 47 are the same as in the embodiment of FIG. 6.

The machine has a displacer 54 for the higher-temperature stage, and a displacer 55 for the lower-temperature stage. Even though the working volumes of the two-stages differ by the factor 4, the gas masses flowing therethrough are almost identical, because of the different gas densities, i.e., the maximum and minimum pressures during the gas exchange to the two-stages also differ only slightly.

FIG. 7 shows the low-temperature stage in phase 2–3 (see FIG. 2) and the high temperature stage in phase 0–1. Volume 56 and regenerator volume 57, then also the working volume above displacer 54, are charged through 58, 59, 60, and gap 78 (adjacent the surface to be cooled). At the same time, the gas from working volume 61 of the low-temperature stage is pumped off through gap 62, at the surface to be cooled, through a first regenerator 63 of lead balls, and a second regenerator 64 of a bronze lattice, and through 65, 66, 67.

Drive piston 68 of displacer 55 of the low-temperature stage at the same time serves for pneumatically actuating control valve 47 through control conduits 60,70,71,27. The medium pressure in tank 53 is used as reference pressure. This pressure is present below displacer 54 in volume 73, and below drive piston 68 at 74. Throttles 75 and 76 are provided to adjust the speed of the displacer movements.

By means of reversing valve 47, gas is alternately supplied by the compressor from the low-temperature stage of the refrigerating machine into the higher-temperature stage, and vice versa. Each time compression energy is recovered. In this way, the power input and compressor size come very close to the Carnot minimum attainable at the selected pressure level and pressure difference.

While specific embodiments of the invention have been shown and described in detail to illustrate the application of the principles of the invention, it will be understood that the invention may be embodied otherwise without departing from such principles.

What is claimed is:

1. A regenerative refrigerating machine comprising:
   - a housing defining a working space;
   - a displacer movable in said housing for changing the volume of said working space;
   - displacer drive means connected to said displacer for moving said displacer in said housing;
   - a compressor having a high pressure side and a low pressure side;
   - valve means connected between said compressor low and high pressure sides and said housing;
   - an intermediate vessel connected to said valve means for receiving a gaseous coolant at a medium pressure between a maximum and a minimum pressure of a cyclic cooling process for said refrigerating machine;

said valve means with compressor operable during an expansion phase of said process to directly pump gaseous coolant out of said working volume, to compress the gaseous coolant to a pressure above a pressure thereof in said working volume and supply the coolant to said intermediate vessel;

said valve means and compressor comparable during a compression phase of said process to pump coolant out of said intermediate vessel to said working volume.

2. A refrigerating machine according to claim 1, wherein said compressor comprises a rotary piston compressor.

3. A refrigerating machine according to claim 2, wherein said compressor is of the oil-lubricated type, a high pressure tank connected to said valve means for receiving high pressure coolant from said compressor and separating oil therefrom, said valve means and said displacer drive means including oil separation bellows for precluding oil from said working volume.

4. A refrigerating machine according to claim 2, wherein said compressor is of the dry running type.

5. A refrigerating machine according to claim 1, including a second working volume in said housing, a second displacer movable in said housing and second displacer drive means connected to said second displacer, said second working volume forming said intermediate vessel, said valve means connected to said first mentioned and second working volumes for alternately providing pressurized coolant from said compressor to said first mentioned and additional working volumes.

6. A refrigerating machine according to claim 5, including an accumulator vessel connected to said valve means for accumulating a medium pressure between a maximum and a minimum pressure of said process, acting as a reference pressure for said valve means and for said displacer drive means.

* * * * *